US005884451A

United States Patent [19]

Kano et al.

[11] Patent Number: 5,884,451

[45] Date of Patent: Mar. 23, 1999

[54] CARTON PROCESSING SYSTEM AND CARTON PROCESSING METHOD

[75] Inventors: Kenichi Kano; Naoki Yoshinari, both of Miyagi, Japan

[73] Assignee: Sony Corporation, Japan

[21] Appl. No.: 855,989

[22] Filed: May 14, 1997

Related U.S. Application Data

[62] Division of Ser. No. 549,217, Oct. 27, 1995, Pat. No. 5,810,487.

[30] Foreign Application Priority Data

Oct. 31, 1994 [JP] Japan ..... 6-267873

[51] Int. Cl.[6] ..... B65B 61/02

[52] U.S. Cl. ..... 53/411; 53/131.4

[58] Field of Search ..... 53/411, 131.1, 53/131.2, 131.4, 462, 207

[56] References Cited

U.S. PATENT DOCUMENTS

| | | | |
|---|---|---|---|
| 3,526,773 | 9/1970 | Davis | 53/131.3 X |
| 3,628,858 | 12/1971 | Dittner | 53/131.4 X |
| 4,655,026 | 4/1987 | Wigoda | 53/131.3 X |
| 5,445,367 | 8/1995 | Long | 53/411 X |

FOREIGN PATENT DOCUMENTS

| | | | |
|---|---|---|---|
| WO 91/10595 | 7/1991 | WIPO | 53/131.4 |

*Primary Examiner*—James F. Coan
*Attorney, Agent, or Firm*—Ronald P. Kananen

[57] ABSTRACT

A system for processing a carton includes a unit for supplying articles for printing, a unit for printing the contents of articles supplied from the supplying unit so as to be housed within the carton, including the names or quantity of the articles to be housed within the carton, or the printing pattern, a unit for assembling the article to be printed to a carton shape from its developed state, a unit for loading the articles to be housed within the article to be printed assembled in the carton shape by the assembling unit, a transporting unit for interconnecting the unit for supplying the articles for printing, printing unit, assembling unit, and the loading unit; and a production supervising computer controlling the unit for supplying the articles for printing, printing unit, assembling unit, loading unit and the transporting unit. The printing patterns printed by the printing unit on the articles for printing are automatically switched based upon a production supervising signal outputted by the production supervising computer.

8 Claims, 14 Drawing Sheets

CARTON PROCESSING SYSTEM AND CARTON PROCESSING METHOD

This application is a division of application Ser. No. 08/549,217 filed Oct. 27, 1995, now U.S. Pat. No. 5,810, 487.

BACKGROUND OF THE INVENTION

This invention relates to a carton processing system and a carton processing method in which the contents of the articles contained in a carton, such as the name, model name, design statements or quantities of the articles, are printed as a printing pattern on the surface of the carton formed integrally with a lid. The articles contained in the carton may, for example, be tape cassette casings or disc cartridge casings. With the carton processing system for color printing a carton board box housing e.g. tape cassette casings, a printing pattern, such as characters or picture patterns, is printed on a cardboard, such as crude roll paper or sheet. The printed crude roll paper or sheet is punched by a die matrix and cut to a pre-set shape. In addition, fold lines are applied at pre-set positions by press-working for folding to a carton shape.

The cardboard piece thus punched to a pre-set outer shape (punched carton unit) is folded along the folding lines and a sizing is applied to part of the folded surface. The punched carton unit is then assembled to the shape of a box. This box, that is the crude roll board or cardboard formed into a box shape, is referred to herein as a carton-shaped box product.

The conventional carton processing system is hereinafter explained. The carton processing system is roughly made up of a printing device for printing the crude cardboard, an assembly device for assembling the punched carton unit to a carton shape and a loading device for charging the articles in the carton-shaped box product.

The printing device prints a printing pattern at a pre-set position on the crude cardboard. The assembly device assembles the punched carton unit, obtained after punching the crude cardboard having the printed pattern printed thereon, to the shape of a carton-shaped box product. The loading device charges a pre-set number of the articles in the carton-shaped box product.

For printing the crude cardboard by the above-described carton processing system, the printing process performs a preliminary printing step for printing the printing pattern. This preliminary printing step is made up of first to sixth sub-steps as hereinafter explained with reference to FIG. 1.

The first sub-step is an original preparing sub-step of preparing a color printing original carrying a desired printing pattern, such as characters or picture pattern, desired to be printed in color on the crude roll paper or sheet. The second sub-step is a master making sub-step of preparing a color printing master plate for each of four colors for color printing on the crude roll paper or sheet. The third sub-step is a sub-step of adjusting and arranging each of the four-colored master printing plates.

The fourth sub-step is a position adjustment sub-step of adjusting the printing positions of the respective colors of the respective master plates and the overlapping state of the respective colors. With this position adjustment sub-step, the respective master plates are matched to the designated printing areas of the plain crude roll paper or sheet with respect to the X-axis position, Y-axis position and Z-axis position. The Y-axis position is the position on the Y-axis perpendicular to the X-axis, while the Z-axis position is the position in the direction of rotation about the Z-axis perpendicular to both the X and Y axes.

The fifth sub-step is a test printing sub-step for conforming the coloring positions of the respective colors. The sixth sub-step is the ink concocting sub-step of adjusting the color tone or viscosity of the printing ink. The crude roll paper or sheet is printed in the wake of the preliminary printing step consisting of these first to sixth sub-steps.

The deficiencies of the above-described carton processing system and the preliminary printing step used in the system are as follows: First, the carton processing system, which is in need of the six preliminary printing sub-steps prior to printing, is not suited to multi-species small-quantity production of cartons.

Second, with the carton processing system, the printed crude cardboard is punched and fold lines as well as cuts are formed therein. Since the carton processing system employs punching with the aid of a punching die matrix and press working, the punching position and cuts are susceptible to position errors. The result is that position errors are also produced in the printed pattern formed on the carton-shaped box product.

If, with the carton processing system, the printing device has a photosensitive drum, since the value of the bias voltage applied at the time of printing differs with the quality of the crude roll paper or sheet, such as high-quality Kent paper or regenerated paper, it becomes necessary to alter the value of the applied bias voltage depending on the quality of the crude roll paper or sheet.

In addition, since it is difficult in the adjustment operation performed in the position adjustment sub-step of the preliminary printing step to adjust the position of the printing pattern in the X-axis direction, in the Y-axis direction and in the rotating direction about the Z-axis into register with the designated printing area on the crude roll paper or crude roll sheet, it becomes necessary to effect position matching operations a plural number of times, with the consequence that prolonged time is consumed in the printing position adjustment operations. That is, the carton processing system is in need of large-sized device, including the printing device, and sufficient technical experience and skill for the operation and adjustment of the printing device.

On the other hand, with the conventional carton processing system, if the printing pattern for the article is changed, it becomes necessary to perform an operation of adjusting the printing position of the printing pattern even if the printing pattern has once been adjusted as to the printing position. That is, the position adjustment of the printing position of the printing pattern lacks in reproducibility.

For assuring reproducibility in the position adjustment of the printing pattern, the carton processing system may employ, as simplified means, a computer having a picture processing function. However, with the carton processing system, the output rate of the information signals, having the printing pattern position adjusted by the picture processing function, is slower than the production tact time on the carton processing line. The result is that the printing speed for the printing pattern by the printing device cannot be synchronized with the supply rate of supplying the article to the printing device. Consequently, this sort of the carton processing system has not been put to practical utilization.

OBJECTS AND SUMMARY OF THE INVENTION

It is therefore an object of the present invention to provide a carton processing system in which the printing position of the printing pattern can be easily and positively reproduced and productivity may be improved for reducing the production cost.

It is another object of the present invention to provide a carton processing method whereby position errors in the printed pattern may be reduced and the printing quality may be improved.

According to the present invention, there is provided a system for processing a carton including means for supplying articles for printing, means for printing the contents of articles supplied from the supplying device so as to be housed within said carton, including the names or quantity of the articles to be housed within the carton, or the printing pattern, means for assembling the article to be printed into a carton shape from its developed state, means for loading the articles to be housed within the article for printing assembled in the carton shape by the assembling means; transporting means for interconnecting the means for supplying the articles for printing, printing means, assembling means, and the loading means, and a production supervising computer controlling the means for supplying the articles for printing, printing means, assembling means, loading means and the transporting means. The printing patterns printed by the printing means on the articles for printing are automatically switched based upon a production supervising signal outputted by the production supervising computer.

The printing means preferably has picture read-out means for reading out a printing pattern of a color printing original for printing on the articles for printing.

The printing means preferably has a movement mechanism for moving the position of the color printing original set on the picture read-out means. The transporting means has a supply controller for controlling the supply rate of the articles to be printed.

A coating means is preferably provided for applying a printing protective agent on printing surfaces of the printed articles.

A detection means is preferably provided for detecting design statements of the articles to be printed when the articles are supplied to the printing means. The detecting means preferably includes a detection light source for illuminating the articles for printing having detection openings and light receiving means for receiving the detection light radiated by the detection light source. The detection means detects the detection light passed through the detection openings for discriminating the design statements of the articles for printing. The detection means preferably includes a detection light source for illuminating the articles for printing punched to a pre-set outer shape, and light receiving means for receiving the detection light radiated by the detection light source. The detection means preferably detects the outer shape of the articles for printing for discriminating the design statements of the articles for printing.

According to the present invention, there is also provided a method for processing a carton includes the steps of printing the printing pattern and the contents of articles housed within the carton, including the name and the quantity of the articles to be housed, on an article for printing; and a second step of assembling the supplied article for printing into a carton and accommodating the articles to be housed in the assembled carton. The articles for printing, punched to a pre-set shape and having folding lines formed in pre-set portions, are supplied to the first step.

According to the present invention, there is provided a method for processing a carton including the first step of assembling articles for printing punched to a pre-set shape and having folding lines formed at pre-set portions thereof to a carton shape and accommodating articles to be housed in the assembled carton; and the second step of printing the printing pattern and the contents of articles housed within the carton, including the name and the quantity of the articles to be housed, on the outer surface of the article for printing.

The printing step preferably prints the printing pattern as from a position spaced apart a pre-set distance from the position of folding lines by which the article for printing is assembled to a carton shape. The printing step preferably includes a sub-step of printing a common printing pattern portion of different printing patterns on articles for printing and a sub-step of separately partially printing non-common printing patterns of the different printing patterns on the articles for printing on which the common printing pattern has been printed.

With the above-described carton processing system of the present invention, since the printing indicating the contents of printing, such as name of quantity of the articles for printing or the printing pattern applied by the printing device on the articles for printing, is automatically changed over based upon the production supervising signal outputted by the production supervising computer, the printing position may be reproduced easily and reliably thus eliminating the printing position adjustment operations.

The present carton processing system effects printing on the articles for printing based upon the picture information signals read out by the picture readout means of the printing device. The printing device adjusts the position of the color printing original set on the picture read-out unit by a movement mechanism. The transport device outputs the information signals by the picture read-out unit of the printing device for controlling the supply rate of the articles for printing supplied to the printing device. Thus the printing device synchronizes the printing speed of the articles for printing supplied to the printing device to the supply rate of the articles for printing to the printing device. The detection means of the carton processing system discriminates the design statements of the articles for printing supplied to the printing device.

On the other hand, with the carton processing method of the present invention, since the printing pattern is printed on an article for printing punched to a pre-set outer shape and hence the printing is not affected by punching position errors produced during punching the articles for printing to a desired shape, there is produced no position error in the printed printing pattern. In addition, with the resent carton processing method, since the printing is performed on the outer peripheral surface of the article for printing assembled to a carton shape, there is produced no position error nor printing defect in the printed pattern.

In short, with the above-described carton processing system according to the present invention, since the printing pattern printed on the article for printing by the printing device is automatically changed over based upon the production supervising signal outputted by the production supervising computer, and hence the adjustment operation for the printing position of the printing pattern may be eliminated, thus improving the carton production efficiency and reducing the carton processing cost.

With the carton processing method of the present invention, the position errors of the printing pattern may be reduced by supplying the article for printing previously punched to a pre-set outer shape to the printing device. In addition, with the present carton processing method, printing position errors and printing defects may be reduced by performing the printing on the outer surface of the article for printing assembled to a carton shape.

DETAILED DESCRIPTION OF THE PREFERRED EMBODIMENTS

Figure 1:
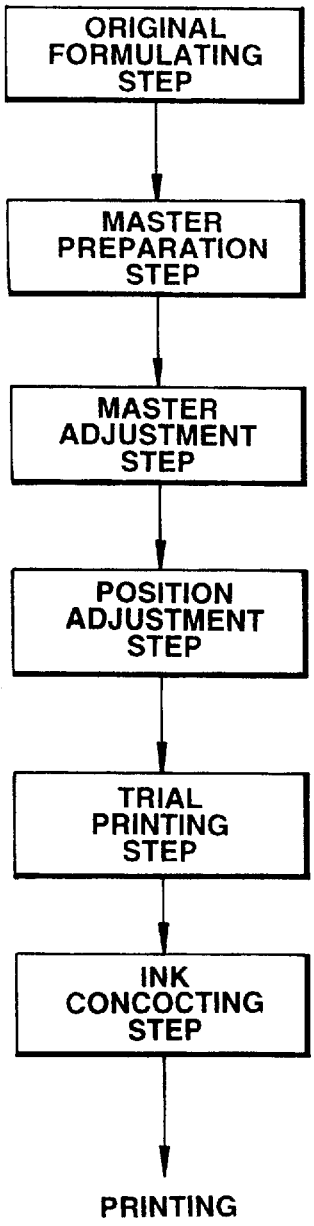
FIG. 1 is a flow chart for illustrating the preliminary printing step in the printing process of the conventional carton processing system.
Figure 2:
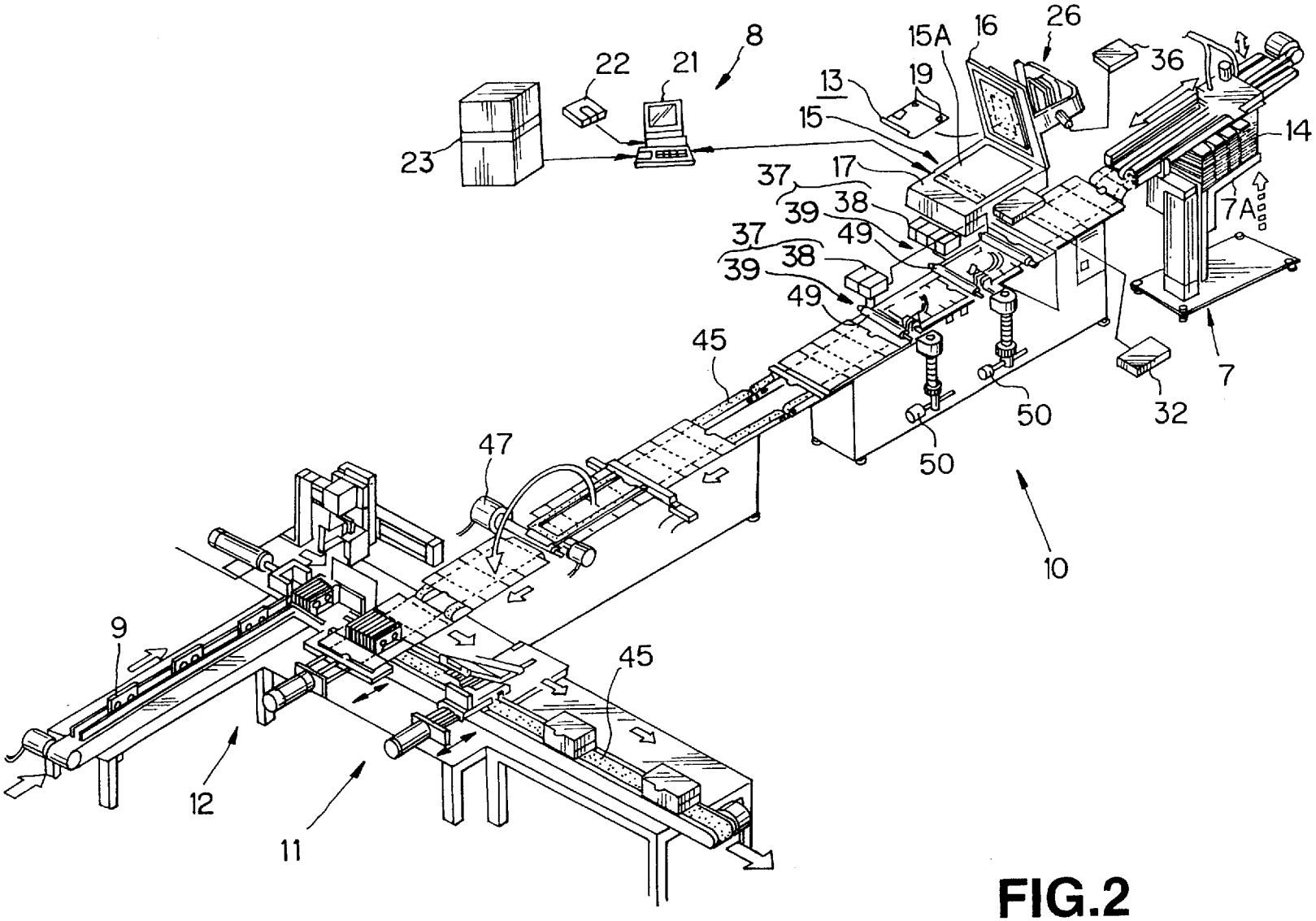
FIG. 2 is a perspective view showing a carton processing system embodying the present invention.

Referring to FIGS. 2 to 14, illustrative embodiments of the present invention will be explained in detail. As shown in FIG. 2, a carton processing system 1 of the instant embodiment includes an article supplying device 7 for supplying articles for printing and a printing device 10 for printing the contents of the articles 9 on the articles 14. The system 1 also includes an assembling device 11 for assembling the printed articles 14 in the shape of cartons and a loading device 12 for charging the articles 9 in the assembled carton. The system 1 finally includes a transporting device 18 interconnecting the respective devices and a controller having a production supervising computer 23 for controlling the respective steps.

Figure 5:
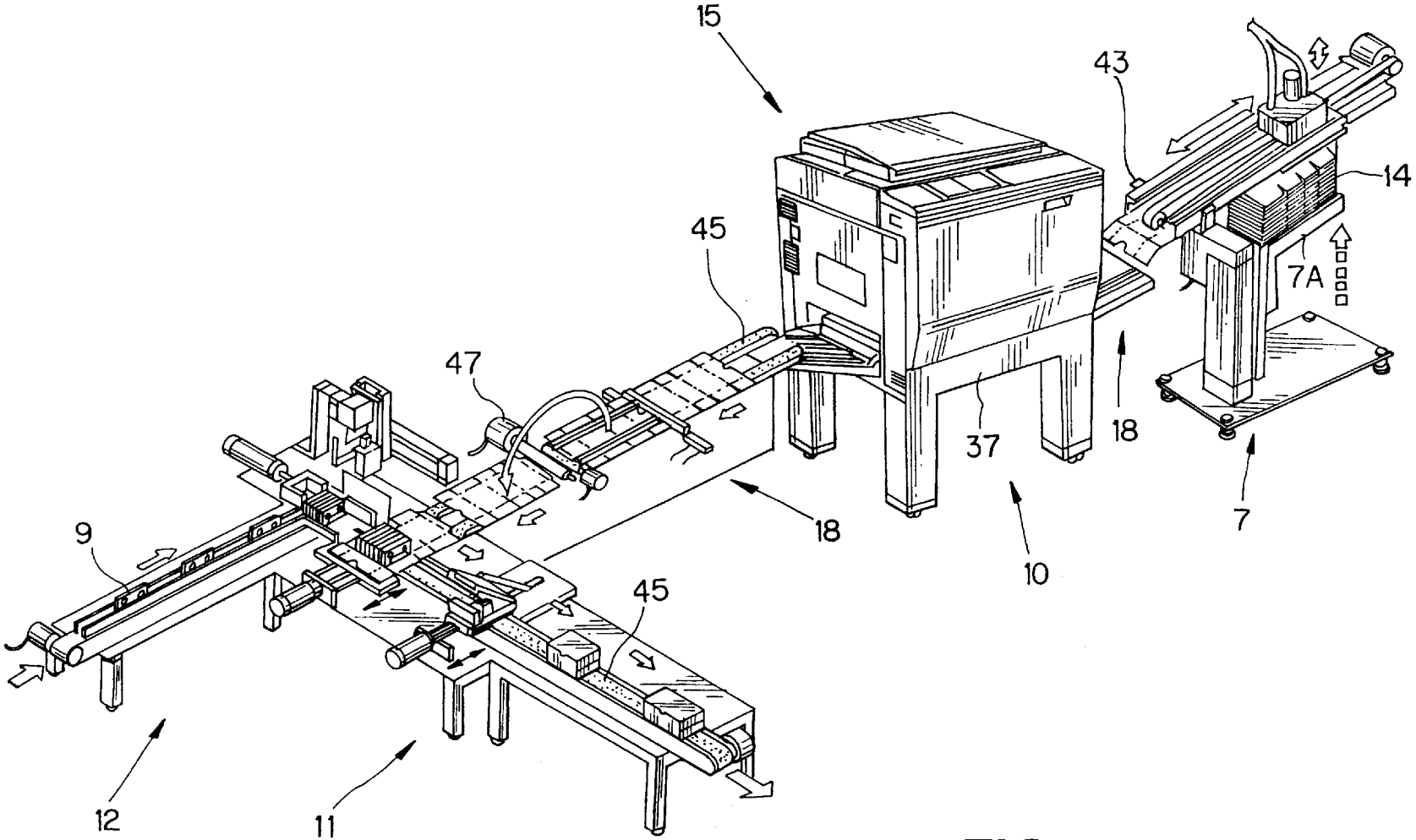
FIG. 5 is a perspective view showing the carton processing system shown in FIG. 2.

The article supplying device 7 a stocker 7A, mounted for sliding movement, as shown in FIGS. 2 and 5. The article supplying device supplies a pre-set number of articles 14 loaded on the stocker 7A to the printing device 10. The printing device 10 has a picture read-out unit 15 for reading out a color picture original 13 and a movement mechanism 26 for shifting the color original 13 placed on the picture readout section 15 and a printing unit 37 for printing the article 14.

Figure 3:
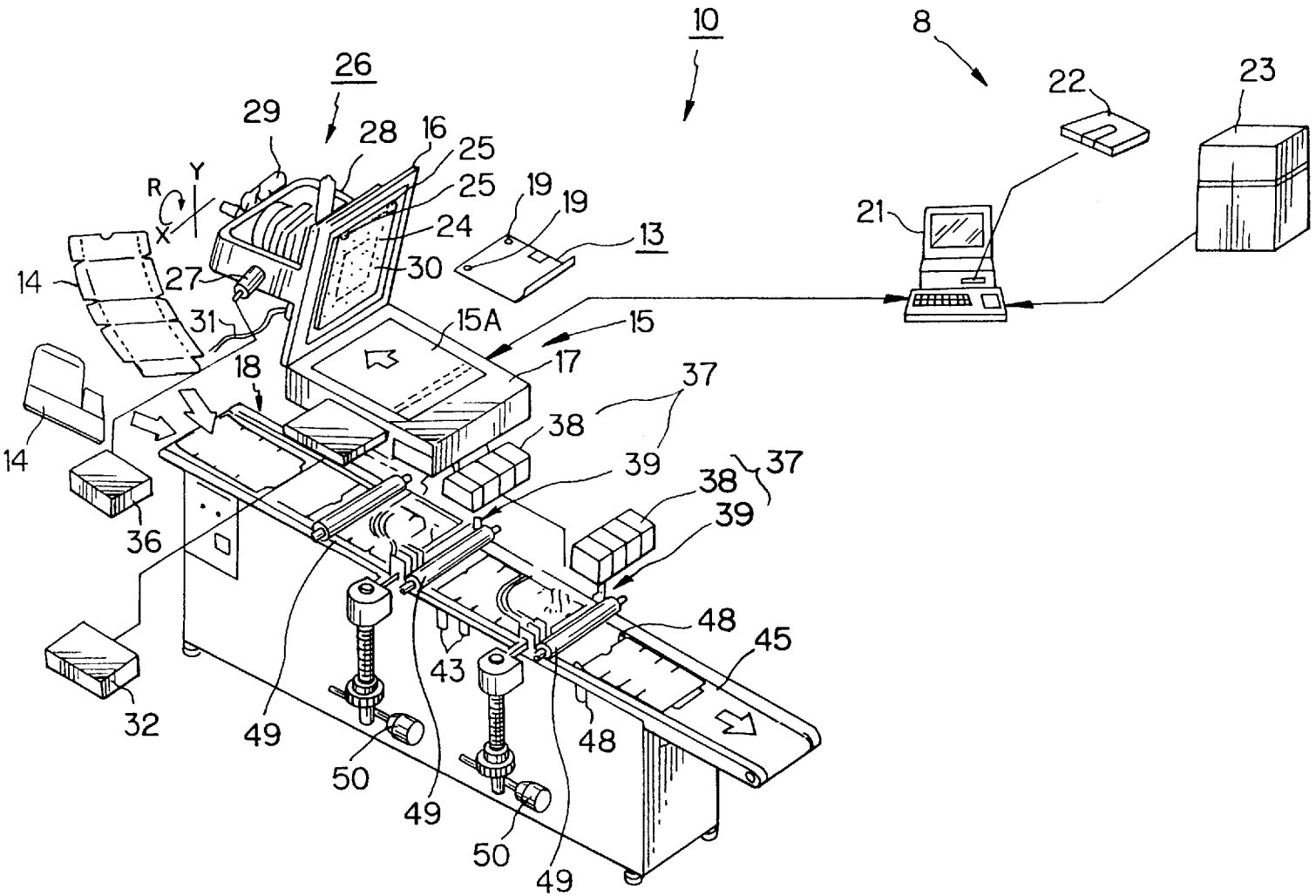
FIG. 3 is a perspective view showing a printing device constituting the carton processing system shown in FIG. 2.

The picture readout unit 15 has a picture readout surface 15A from which it reads the picture of a printing pattern drawn on a color printing original 13 using a color CCD scanner 17, as shown in FIGS. 2 and 3. The picture readout unit 15 accesses to a picture information reproducing device 21 on which is loaded a optical disc (CD-ROM) 22 having pre-recorded thereon the picture information signals of the same printing pattern as that of the color printing original 13.

The picture readout unit 15 reads out the picture information signals from the picture information reproducing device 21 designed to reproduce picture information signals, and separates the picture information signals into three colors of red (R), green (G) and blue (B). The picture readout unit 15 outputs the respective color signals, separated in color from the from the picture information signals, to a printing unit 37.

Alternatively, it is possible for the picture readout unit 15 to directly output the information signals to the printing unit 37 for printing based upon the information signals read from the color printing original 13 by the color CCD scanner 17. That is, since the printing unit 37 of the picture readout unit 15 directly performs the printing based upon information signals read out from the color printing original 13, printing can be performed without producing errors in the color tone of the color printing original 13, thereby improving the printing quality of the printing pattern or the production tact time.

The read-out picture information signals are made up of three color signals of R, G and B signals. The picture readout unit 15 converts the pixel-based R, G and B signals into corresponding digital signals and outputs the converted signals to the printing head 39 or the photosensitive drum 40 of the printing unit 37, while outputting a supply rate control signal to the transporting device 18 so that the printing speed of printing on the articles 14 by the printing unit 37 will be synchronized with the supply rate of the articles 14 to the printing unit 37.

Figure 4:
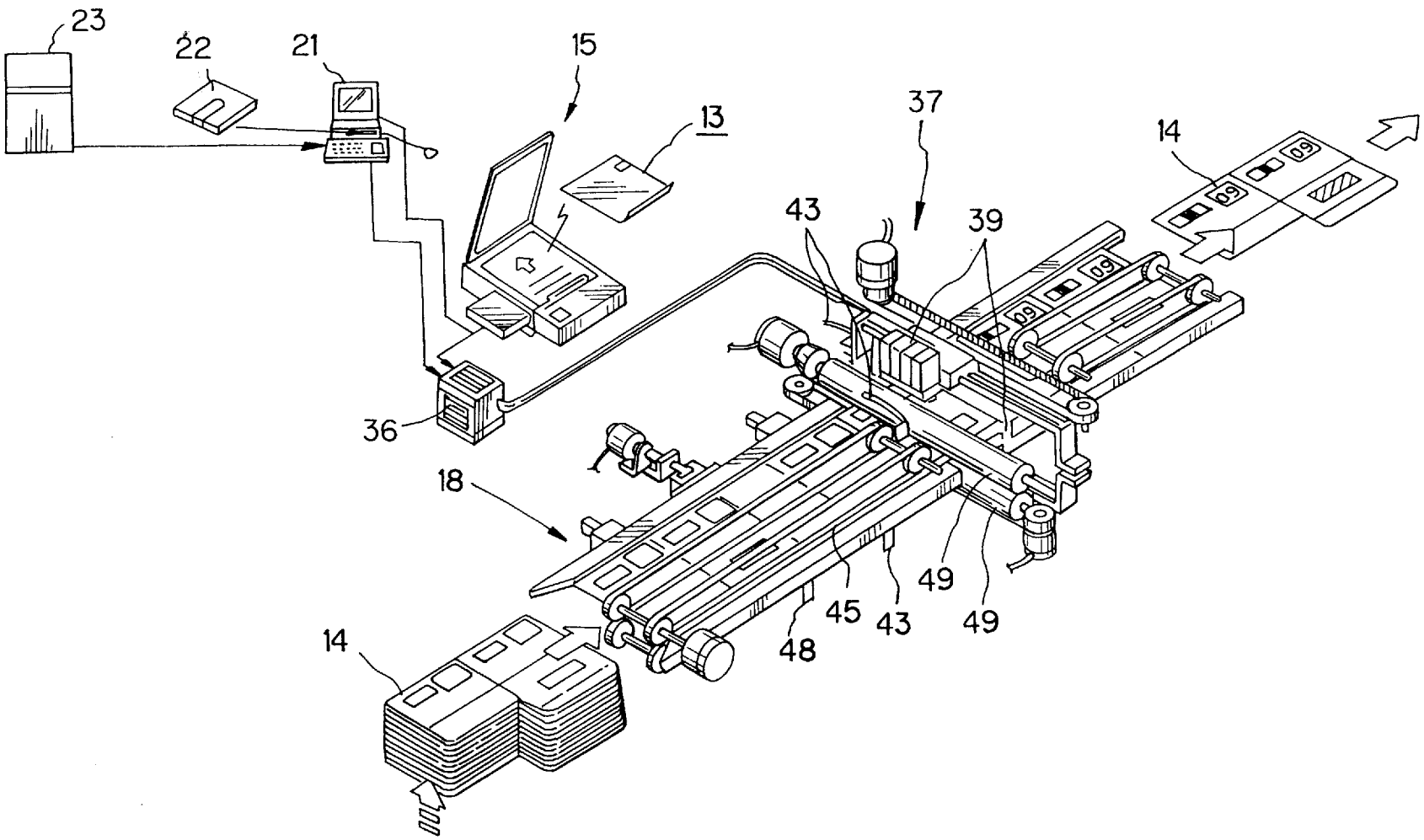
FIG. 4 is a perspective view showing essential positions of a printing device constituting the carton processing system shown in FIG. 2.

The printing unit 37 has a printing head 39 having plural minute-sized nozzles from which the ink is ejected to the designated printing areas of the articles 14 for effecting printing, as shown in FIGS. 3 and 4. This printing head 39 is of the ink-jet system in which printing is performed in a contact-free state, that is without the printing head 39 being abutted against the articles 14.

The printing unit 37 has a stepping motor 50 adapted for moving the printing head 39 towards and away from the article 14 for optionally adjusting the facing distance between the printing head 39 and the article 14.

The printing head 39 is of the dual ink jet type, as shown in FIG. 2, and is designed for printing both the front and back surfaces of the article 14 placed on the belt conveyor 45. Alternatively, the printing head 39 may be of a single side ink jet type as shown in FIG. 3 for printing only one surface of the article 14 placed on the belt conveyor 14.

The printing head 39 has ink tanks 38 respectively containing three prime color inks of cyan, magenta and yellow and sepia, and is connected to ink supply ducts, not shown, led out from these ink tanks 38. The printing head 39 performs color printing on the designated printing areas of the article 14 supplied from the transporting device 18 based upon color-separated digital signals supplied from the picture readout unit 15.

Figure 6:
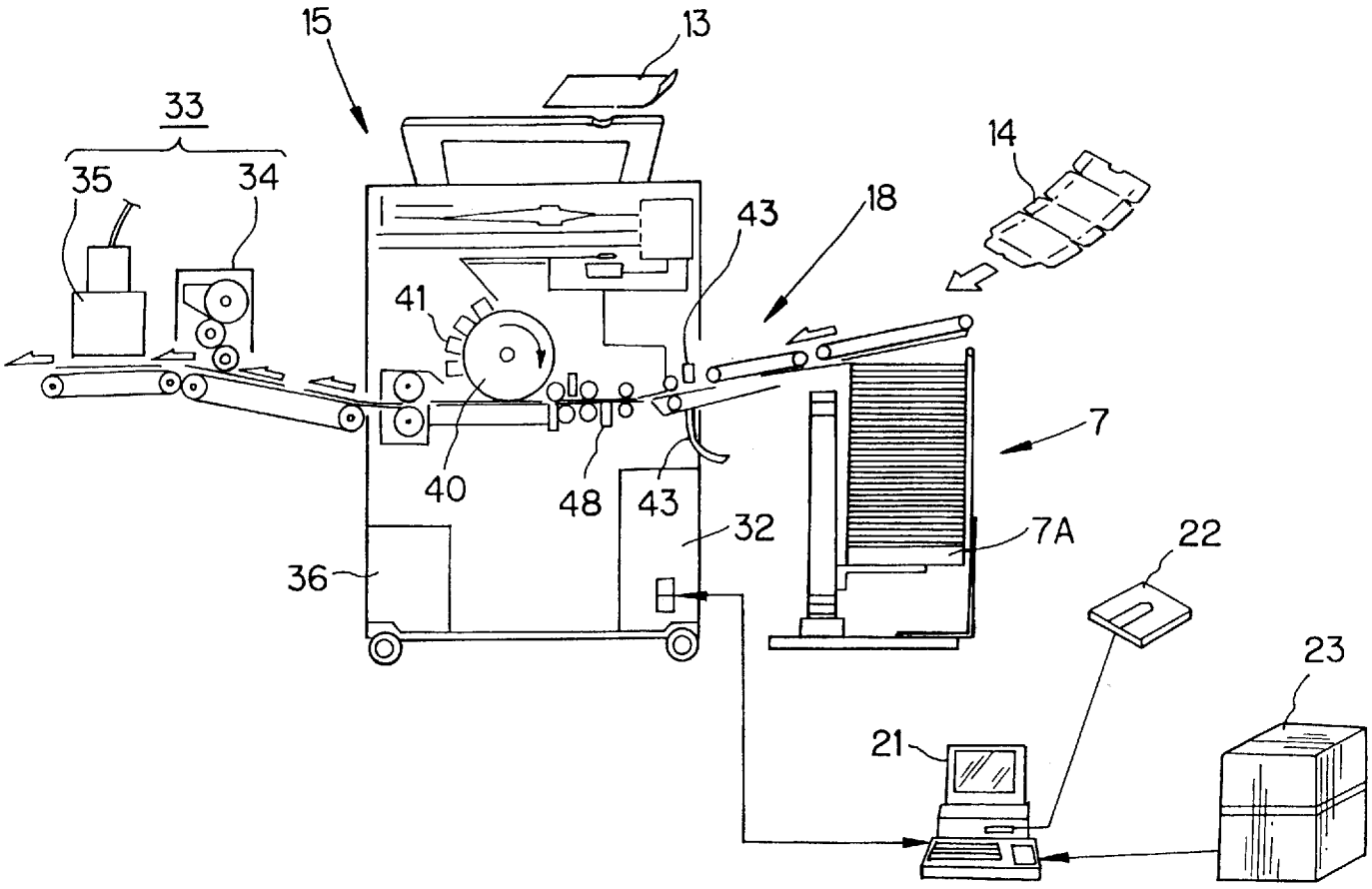
FIG. 6 is a longitudinal cross-sectional view showing the carton processing system shown in FIG. 2.

The printing unit 37 may also be provided with a photosensitive drum 40, in place of the printing head 39, as shown in FIGS. 5 and 6. In this case, the printing unit is of the contact type in which printing is carried out by transfer printing with the aid of a toner electro-statically fixed on the photosensitive drum 40. Plural toner tanks 41, having color toners accumulated therein, are provided on the photosensitive drum 40. The printing unit 37 may be of the type in which printing is carried out by silk screen printing, PAD printing or offset printing.

The driving mechanism 26 is made up of a lid 16 covering the picture readout surface 15A of the picture readout unit 15, a suction plate 24 movably mounted on the lid 16, a movement mechanism 27 for moving the suction plate 24 in a direction shown by arrow X in FIG. 2, and a rotating mechanism 29 for rotating the suction plate 24 in the direction shown by arrow R in FIG. 3.

The lid 16 has its lateral edge supported for opening/closure movement by a pivot, not shown, and includes a suction plate 24. The suction plate 24 is substantially rectangular in shape and movably mounted on the lid surface facing the picture readout surface 15A of the lid 16. The surface of the suction plate 24 facing the picture readout surface 15A is formed with plural suction holes 30.

The suction plate 24 has a hollow inner space communicating with the suction holes 30. A suction port, not shown, is bored in one end of the hollow inner space of the suction plate 24 and connected to one end of a suction tube 31. The suction tube has its other end connected to an air compressor for drawing air into the tube.

At least two pins 25 are mounted on the surface of the suction plate 24 facing the picture readout surface 15A. These mounting pins 25 are inserted into mounting holes 19 bored in the color printing original 13 for provisionally attaching the original 13.

Thus the suction plate 24 positively holds the color printing original 13 provisionally attached by the mounting pin 25 under the force of suction produced by sucking air via the suction openings 30. The suction force of the suction plate 24 is lost when air suction via the suction hole 30 is halted. The color printing original 13 then ceases to be held.

The driving mechanism 26 is made up of first to third stepping motors, not shown, for moving the suction plate 24 with respect to a movement sensor. The first stepping motor shifts the suction plate 24 in the direction shown by arrow X in FIG. 3. On the other hand, the second stepping motor shifts the suction plate 24 in the direction shown by arrow Y, while the third stepping motor rotates the suction plate 24 in the direction shown by arrow R.

To these first to third stepping motors are respectively connected first to third motor driving circuits, not shown. To the first to third motor driving circuits, information signals, derived from position correction data for the suction plate 24, are outputted from the system controller 32. Based upon these information signals, the first to third stepping motors are run in rotation. That is, the first to third stepping motors are respectively driven by position displacement data in the X-, Y-and R-directions, outputted by the system controller 8, respectively.

Thus the suction plate 24 is moved linearly in the X- and Y-directions, while being rotated in the R-direction, by the rotation of the first to third stepping motors. That is, the color printing original 13 attached to the suction plate 24 can be easily adjusted in its position by the movement mechanism 26.

The punched carton units, supplied as articles to be printed 14 to the printing device 10, may be exemplified by e.g., coated cardboard or Kent paper. For printing on the article 14, the printing device 10 changes the impressed voltage depending upon the quality of the article 14 to be printed. For adjusting the voltage applied during printing depending upon the paper quality of the article 14, the transporting device 18 has a detection unit 42 for detecting the quality of the article 14 supplied to the printing device 10.

The detection unit 42 is made up of plural paper quality sensors 43 which are arranged in the vicinity of a belt conveyor 45. Depending upon the paper or board quality, the paper or board quality detection holes 44 are bored in the article to be printed 14.

Figure 10A:
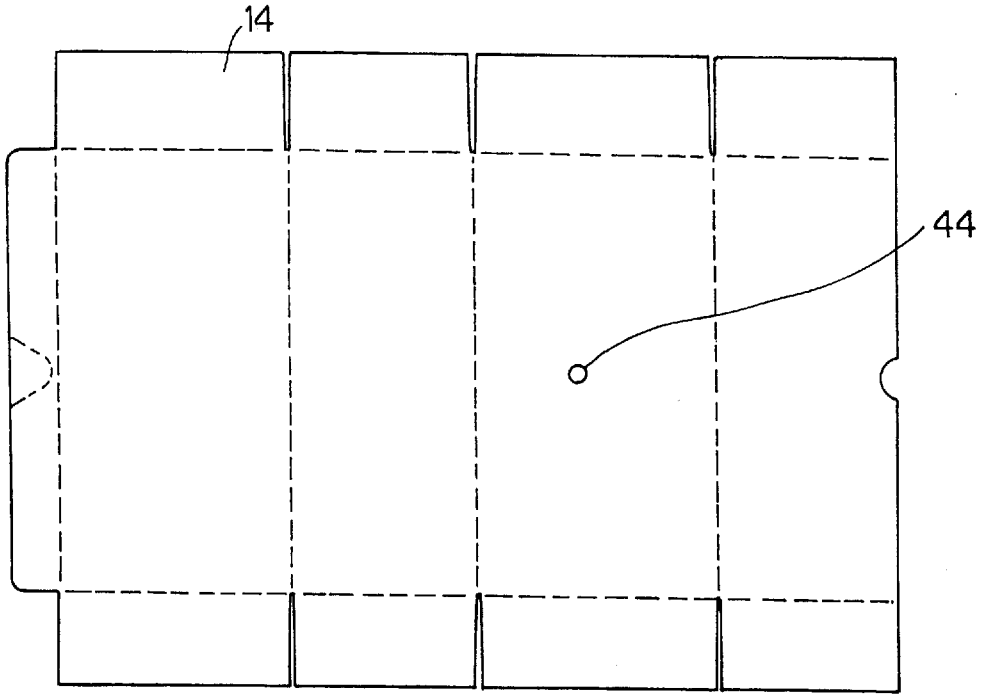
FIGS. 10A and 10B are plan views showing an example of an article supplied to the printing device of the carton processing system shown in FIG. 2.
Figure 10B:
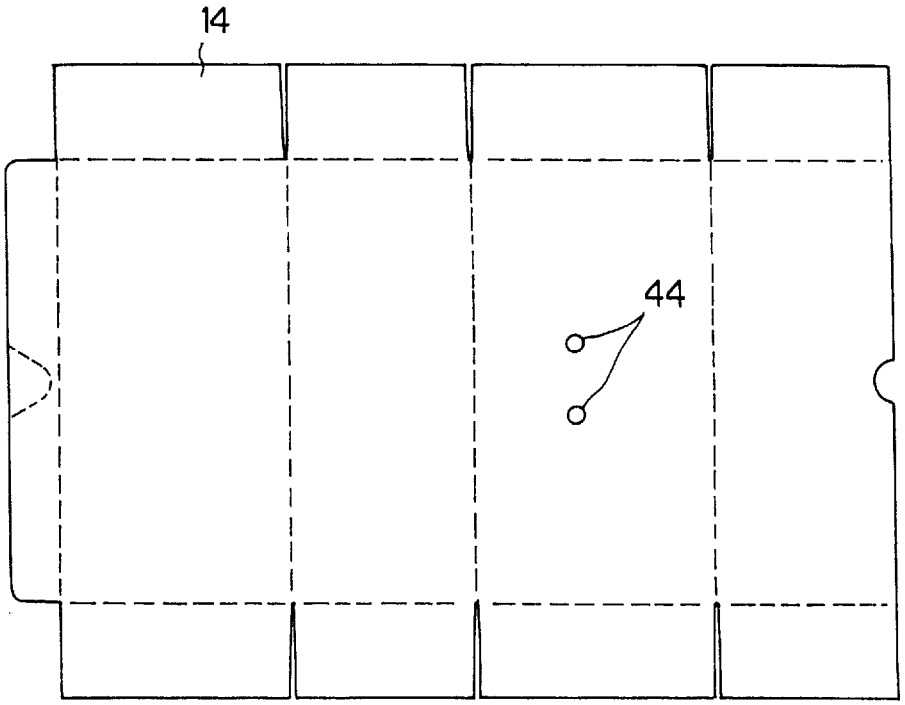
Figure 11:
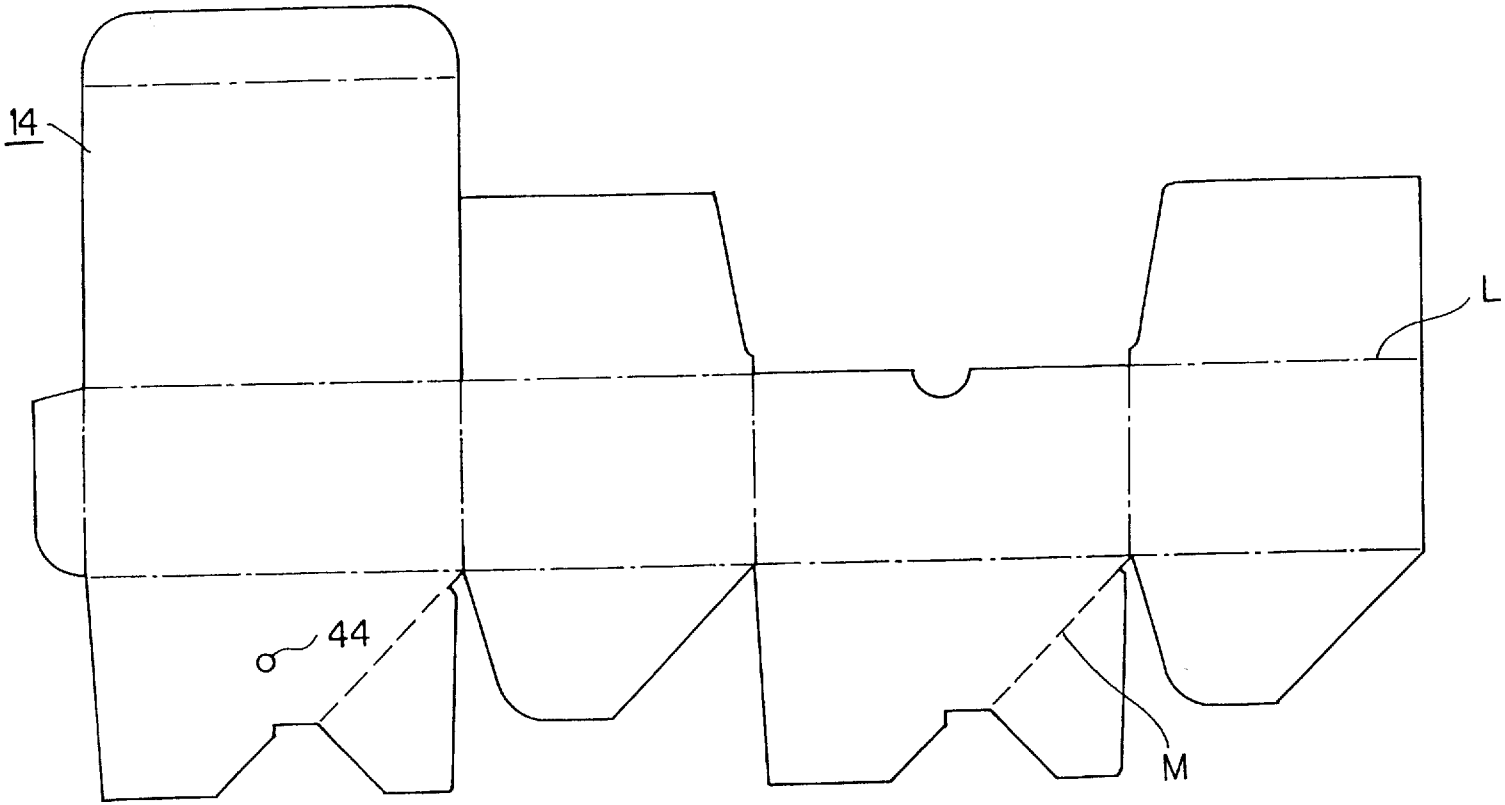
FIG. 11 is a plan view showing an example of an article employed in the carton processing method according to a first embodiment of the present invention.

For example, a coated cardboard has a paper or board quality sensor hole 44, having a diameter of 2 to 10 mm, as shown in FIG. 10A, while a high-quality paper sheet, such as Kent sheet, has two neighboring paper or board quality detection holes 44, with a diameter of 2 to 10 mm, as shown in FIG. 10B.

That is, the paper or board quality sensor 43 discriminates the paper or board quality by detecting the detection light transmitted through the paper or board quality detection hole or holes 44 formed in the major surface of the article 14 supplied to the printing unit 37.

The paper or board quality sensor 43 outputs the detection signal having detected the paper or board quality of the article 14 to the system controller 8. As the paper or quality sensor 43 for detecting the paper board quality of the article 14, a non-contact sensor, such as a laser displacement sensor or an ultrasonic sensor, may be employed.

The carton processing system 1 may be provided with a coating device 33 for coating a printing protective varnish on the printing surface of the printed article 14, by way of performing a step next to the printing by the printing device 10, as shown in FIG. 6. The coating device 33 has a coater 34 for applying a printing protective varnish on the printing surface of the printed article for protecting the printed pattern and improving the appearance of the printing pattern, and a dryer 35 for drying the printing protective varnish applied to the printing surface by the coater 34, as shown in FIG. 6.

If the solvent ink is used as the printing protective varnish, a far infrared ray illuminating type dryer is used as the dryer 35. If the UV ink is used as the printing protective varnish, a UV illuminating type dryer is used.

That is, by coating the printing protective varnish on the printing pattern on the article 14, the printing pattern may be improved in light fastness and water-proofness and the occurrence of discoloration is diminished. On the other hand, scratch-proofness may be improved and the occurrence of peeling or color skip or vanishing is diminished. On the other hand, by increasing the film thickness of the protective film formed by the printing protective film coated on the printed pattern, the printing pattern may be given the feeling of transparency and improved in appearance.

The assembling device 11 folds the printed article into the carton shape and bonds the folded portions together with a sizing to complete a carton. The loading device 12 charges a pre-set number of articles 9 in the assembled carton. The carton processing system of the instant embodiment has the assembling device 11 and the loading device 12 in adjacency to each other on a transport route of belt conveyor 45, as shown in FIGS. 2 to 5.

The operation of loading cassette casings, as articles to be housed 9, in a punched carton unit, supplied as the printed article 14, by the assembling device 11 and the loading device 12, and of assembling the punched carton unit, is explained by referring to FIGS. 7A to 7H. In the following explanation, the upward, downward, left and right directions refer to FIG. 6.

Figures 7A, 7B, 7C, 7D, 7E, 7F, 7G, 7H:
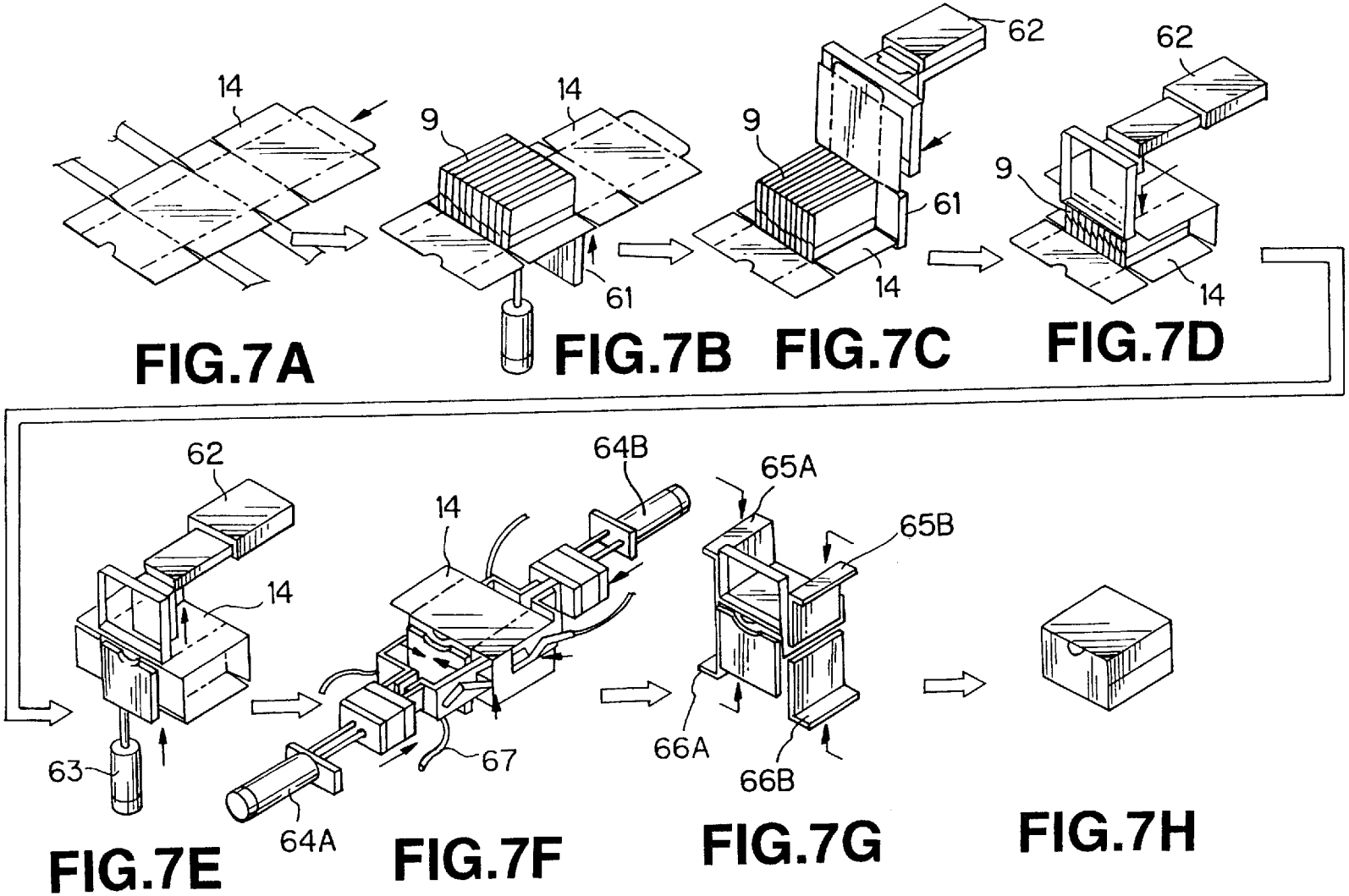
FIG. 7, comprised of FIGS. 7*a* to 7*h*, is a perspective view for illustrating the operation of the assembling and loading devices performed in the carton processing system shown in FIG. 2.

The article to be printed 14 is furnished in an inverted state, that is with the printed surface directed outward, as shown in FIG. 7A. On the furnished printed article 14, a pre-set number of cassette casings as articles to be housed 9 are set, as shown in FIG. 7B.

The article to be printed 14 is folded by a first assembling plate 61 being elevated from a lower position towards a fold line defining a lateral side flap of the cassette casing set on the printed article 14, the first assembling plate 61 being moved in a translatory movement along the lateral side flap of the cassette casing, as shown in FIG. 7C.

The printed article 14 overlies the cassette casing set thereon by a second assembling plate 62 performing a translatory movement along an upper side flap extending perpendicular to the folded lateral side flap, as shown in FIG. 7D. The printed article 14 is folded by a third assembling plate 63 being elevated from the lower side and performing a translatory movement along a lateral side flap of the cassette casing, as shown in FIG. 7E.

Then, both end flaps of the printed article 14 are folded by a set of fourth assembling plates 64A, 64B performing a translatory movement along both end flaps of the cassette casing, as shown in FIG. 7F. When the lateral surfaces of the article 14 are folded in this manner, the sizing is supplied via a sizing supply tube 67 to these lateral surfaces of the article 14.

Then both end flaps of the printed article 14 are folded by a set of fifth assembling plates 65A, 65B being lowered from the upper side and by a set of sixth assembling plates 66A, 66B being elevated from the lower side, as shown in FIG. 7G. The article 14 is kept for some time in the state of being folded on both lateral end flaps folded by the fifth assembling plates 65A, 65B and the sixth assembling plates 66A, 66B. The article 14 is assembled to a carton-shaped box product, having a pre-set number of cassette casings, as shown in FIG. 7H.

The transporting device 18 is roughly constructed by the belt conveyor 45 rotatably supported plural roll members and a belt member stretched on these roll members. This belt conveyor 45 constitutes a passage for transporting the articles 14 to the printing unit 37. In addition, the belt conveyor 45 is arranged between the printing device 10 and the assembling device 11 and between the assembling device 11 and the loading device 12 to constitute a passage for transporting the printed articles 14.

The transporting device 18 also has a stop member 48 for controlling the supply rate of the articles 14 to be supplied to the printing unit 37. This stop member 48 is fed with a control signal from the system controller 32 via the controller 36. When the stop member 48 is actuated by an input control signal from the controller 36, the transporting member 18 halts the articles 14 placed on the belt conveyor 45.

Thus the transporting device 18 suitably controls the supply rate of the articles 14 supplied to the printing unit 37. Since the printing speed of printing on the articles 14 and the supply rate of the articles 14 are positively synchronized with each other, the printing unit 37 is able to perform printing satisfactorily.

The transporting device 18 is provided with a pre-set number of guide rolls 49 in register with the belt conveyor 45. Thus the article 14 placed on the belt conveyor 45 is maintained by the guide rolls at a satisfactory facing distance of the printing surface thereof from the printing head 39.

An article invertor 47 is provided between the printing device 10 on one hand and the assembling device 11 and the loading device 12 on the other hand, as shown in FIGS. 2 and 5. By this article invertor 47, the article 14 transported from the printing device 10 is inverted in its position so that its printed surface faces downwards.

The controller 8 is made up of the production supervising computer 23, picture information reproducing device 21 connected to the production supervising computer 23, system controller 32 connected to the picture information reproducing device 21 and the controller 36 connected to the system controller 32 for controlling the transporting device 18.

Figure 8:
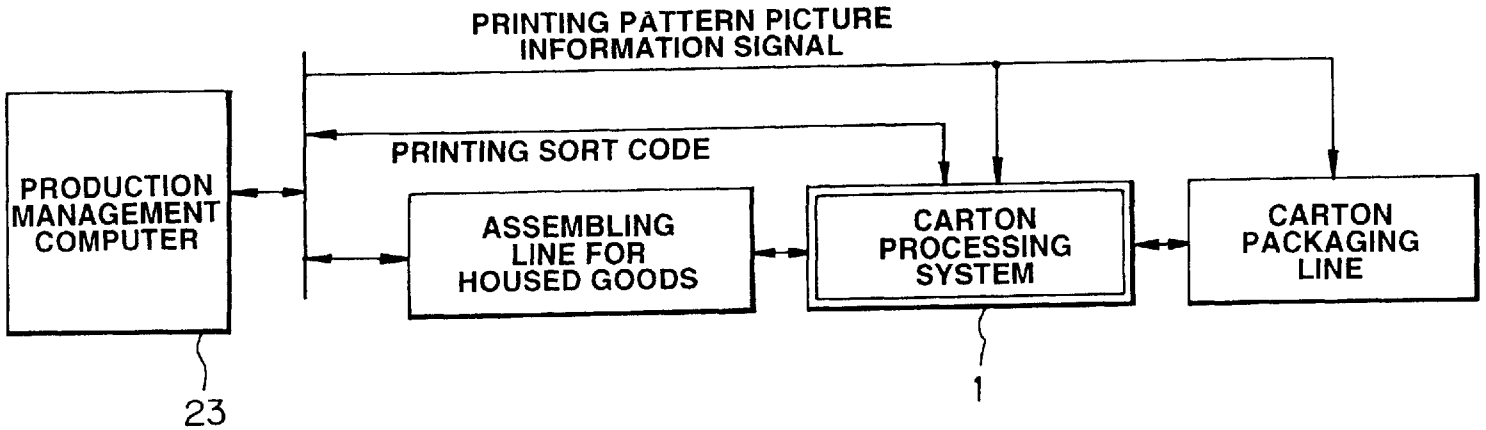
FIG. 8 is a block diagram showing the carton processing system shown in FIG. 2.
Figure 9:
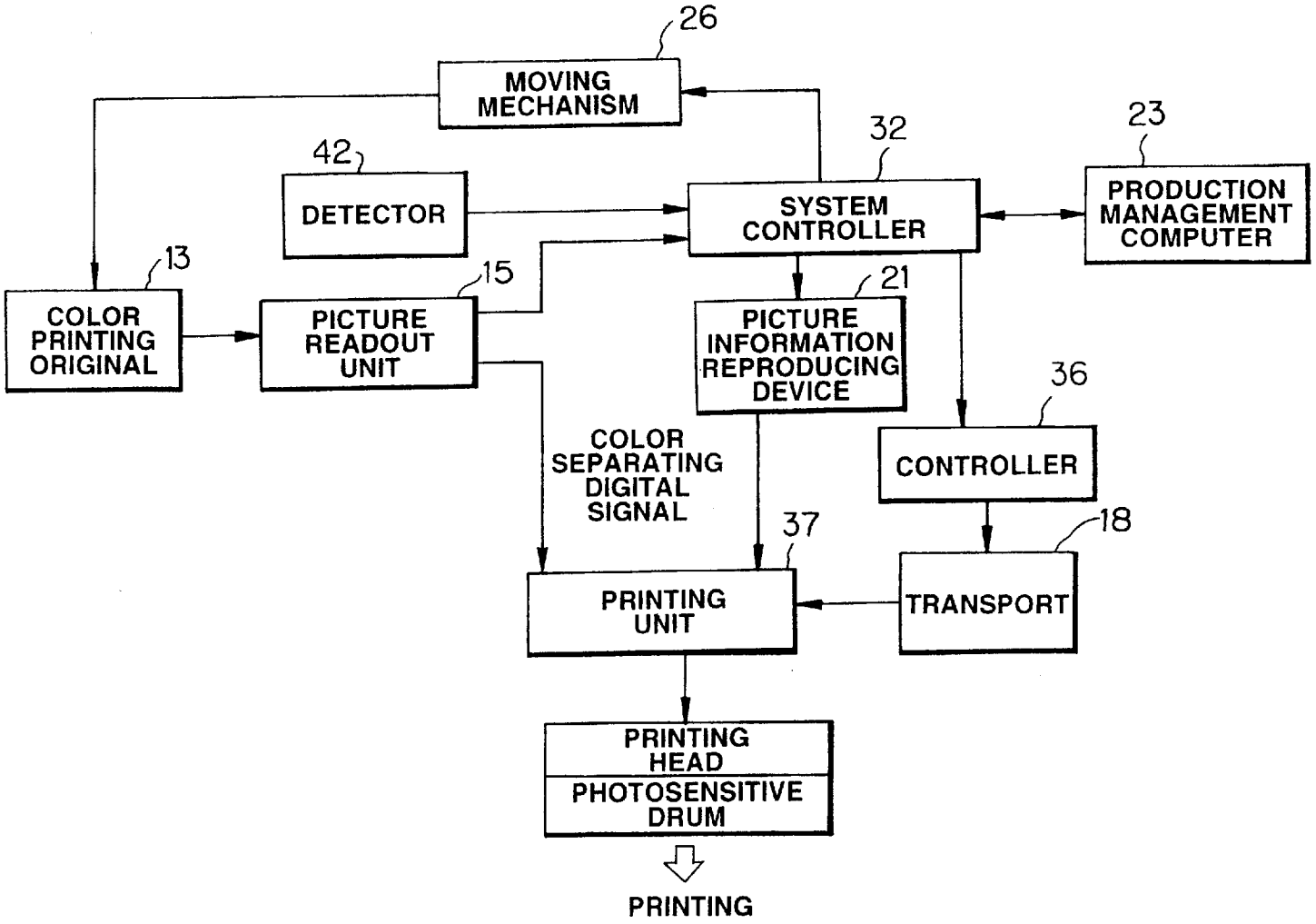
FIG. 9 is a flowchart for illustrating the carton processing system shown in FIG. 2.

Referring to FIGS. 8 and 9, the information signal processed by the controller 8 of the carton processing system 1 is explained. With the present carton processing system 1, the picture readout unit 15 reads out the picture information signal of the color printing original 13 placed on the picture readout surface 15A by the color CCD scanner 17.

The read-out picture information signals are made up of three color signals of R, G and B signals. The picture readout unit 15 converts the pixel-based R, G and B signals into corresponding digital signals and outputs the converted signals to the printing head 10 or the photosensitive drum 40 of the printing head 37.

The picture read-out unit 15 outputs a control signal for synchronizing the printing speed of printing on the article 16 by the printing unit 37 with the supply rate of the articles 14 to the printing unit 37. The system controller 32 controls the controller 36 based upon this control signal. The controller 36 issues a control signal of actuating the stop member 48 to the transport device 18 for synchronizing the printing speed of printing on the article 16 by the printing unit 37 with the supply rate of the articles 14 to the printing unit 37.

The detector 42 outputs the detection signal of detecting the paper or board quality of the articles 14 supplied to the printing unit 37. The system controller 32 is controlled by the production supervising computer 23 by the detection signal from the detector 42 which is outputted to the production supervising controller 23. The production supervising computer 23 checks whether or not there is any improper point in the article to be printed 14.

If automatic exchange of the printing pattern to be printed on the article 14 is to be performed by the printing device 10, a printing category code, indicating the category of the printing desired to be made, is entered to the production supervising computer 23. The production supervising computer 23 controls the system controller 32, based upon the input printing category code, for causing a detection signal to be outputted to the detection unit 42 for checking whether or not the article to be printed 14, supplied to the printing unit 37, is in proper state.

If there is any improper state in the article to be printed 14, supplied to the printing unit 37, the production supervising computer 23 outputs an alarm signal to the printing device 10, while canceling the automatic driving mode of the carton processing system 1 for halting its operation. If the input printing category code coincides with the article 14 supplied to the printing unit 37, the production supervising computer 23 outputs a control signal controlling the picture information reproducing device 21 to the system controller 32 for outputting the picture information signals of a pre-recorded printing pattern to the printing unit 37.

The system controller 32 causes the picture information reproducing device 21 to reproduce the CD-ROM 22 for outputting the picture information signals of the printing pattern recorded on the CD-ROM 22 to the printing unit 37 for automatically switching the printing pattern printed by the printing unit 37 on the article 14.

On the color printing original 13 are printed information signals for actuating the printing mechanism 26 by bar codes which are read by a bar code scanner. The read-out bar-code information signals are outputted to the production supervising computer 23.

The production supervising computer 23 collates the input bar-code information signals to the input printing category codes for checking whether or not the supplied article 14 is in proper condition. If the computer 23 finds that the supplied article 14 is in proper state, a control signal controlling the movement mechanism 26 of the printing device 10 is outputted to the system controller 32.

The system controller 32 controls the movement mechanism 26 via the controller 36 for adjusting the position of the color printing original 13 for automatically adjusting the printing position of the printing pattern to be printed on the article 14. The system controller causes the automatic running mode of the card processing system 1 to be initiated.

Thus it is possible with the carton processing system 1 to output the picture information signals read out by the picture readout unit 15 from the color printing original 13 to the printing unit 37 for causing the printing unit 37 to print the article 14 in accordance with the picture information signals. That is, the carton processing system 1 effects direct printing based upon the picture information signals read out from the color printing original 13.

Thus, with the carton processing system 1, the second to sixth sub-steps of the preliminary printing step, required in a conventional carton processing system, that is the master preparing sub-step, master adjusting sub-step, position adjustment sub-step, test printing sub-step and the ink concoction sub-step, which are in need of technical experiences and skill, are eliminated, thus simplifying the printing process and improving the production efficiency.

In addition, with the carton processing system 1, the printing patterns printed on the article to be printed 14 are switched automatically, so that the printing pattern position adjustment need not be performed from one article to be printed 14 to another, thus improving the production efficiency and allowing to cope with changes in the production scheme easily and promptly.

The carton processing system according to the present invention may be conveniently employed in particular to a production line designed for multi-species small-quantity production of cartons.

Referring to FIGS. 11 to 14, illustrative embodiments of the carton processing method according to the present invention will be explained in detail. A carton processing method 5 according to a first embodiment, employing the carton processing system 1 of the above-described embodiment, is hereinafter explained, while the description of the carton processing system 1 is omitted.

The carton processing method 5 according to the present embodiment includes a first sub-step of printing on the article 14, a second sub-step of assembling the article into a carton, and a third step of accommodating the articles 9 in the assembled carton. With the present carton processing method 5, a punched carton unit, previously punched to a pre-set outer shape and having fold lines L indicated by chain-dotted lines and slits M indicated by broken lines at pre-set locations, is supplied as the article 14 to the first step, that is the printing step.

The first step is a printing step of printing the punched carton unit supplied from the transporting device 18. For this printing step, the punched carton unit is supplied from the transporting device 18 as the article to be printed 14.

The second step is a loading step of housing articles to be housed 9, such as disc cartridges, into the assembled carton.

The transporting device 12 charges a pre-set number of the articles to be housed 9 in the assembled carton. The lid of the carton, having the articles 9 housed therein, is closed.

The third step is a printing step of printing a carton having the articles 9 housed therein. The printing step prints on a designated printing area of the carton by the printing device 10. The carton, on which the printing pattern has been printed, is transported to a packaging step, not shown, for packaging.

The punched carton unit, supplied to the printing device 10 as the article to be printed 14, is not smooth in the portions of the fold lines L and the slit lines M. Thus, if the printing device 10 effects printing by the photosensitive drum 40, printing on the punched carton unit is carried out in accordance with the contact system by transfer printing, so that it is necessary to avoid printing on non-smooth portions provided with the slits M.

Figure 12B:
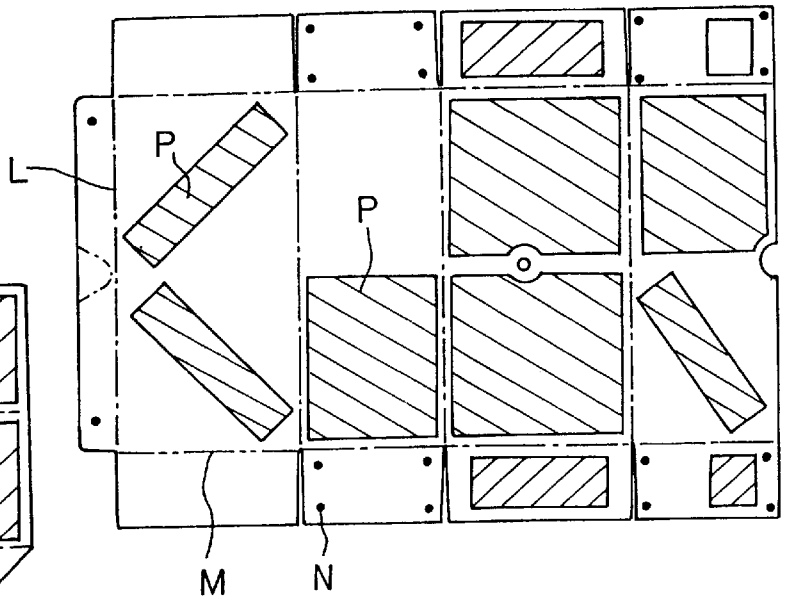
FIGS. 12A and 12B are plan views showing an example of a punched carton article employed for the carton processing method of FIG. 11.
Figure 12A:
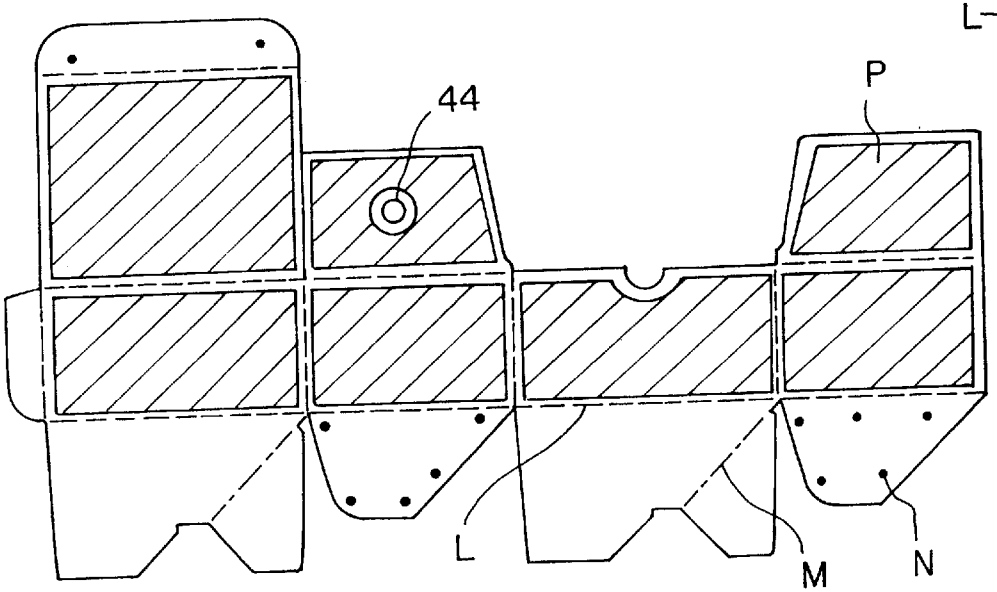

Consequently, printing on the punched carton unit is performed so that a printing pattern P is positioned for avoiding an area of approximately 0.5 to 50 mm from the fold lines L indicated by chain-dotted lines, slits M indicated by broken lines, sizing positions N indicated by black circle marks and paper or board quality detection holes 44, as shown in FIGS. 12A and 12B.

With the carton processing method 5, the printing pattern P is printed on the punched carton unit supplied to the printing device 10 in a manner of avoiding the fold lines L indicated by chain-dotted lines, slits M indicated by broken lines, sizing positions N and the paper or board quality detection holes 44, for assuring satisfactory printing even with the contact printing by the photosensitive drum 40.

Figure 13A:
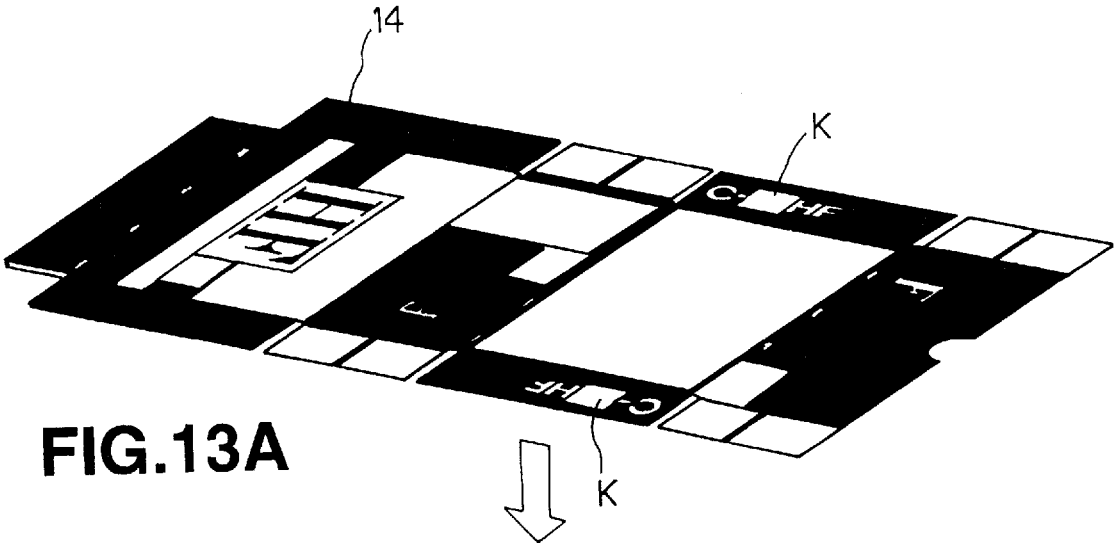
FIGS. 13A and 13B are perspective views for illustrating the state in which partial printing is performed on a punched carton unit by the carton processing method of FIG. 11.
Figure 13B:
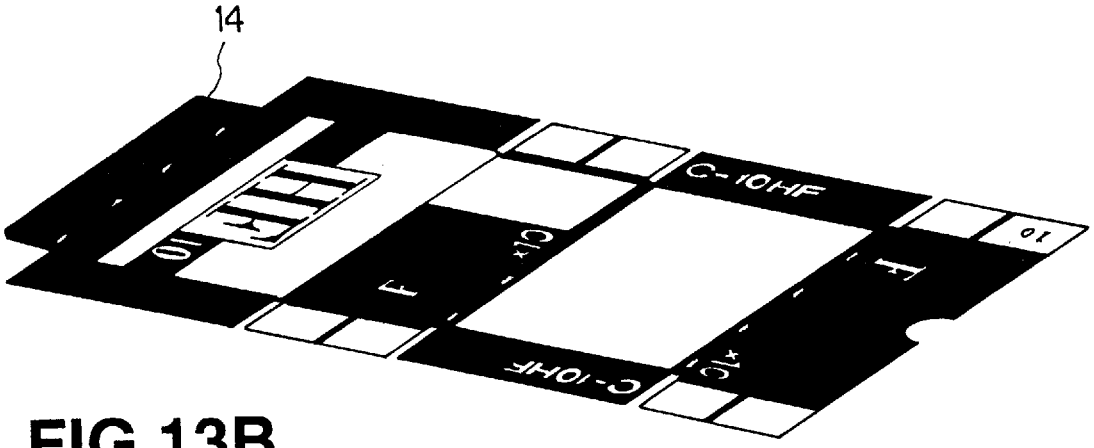

In addition, there are occasions wherein, when printing different printing patterns on the punched carton units with the carton processing method, these different printing patterns have common printing patterns. In such case, it is possible with the carton processing method 5 to print the common printing pattern portion and to subsequently print only the non-common printing pattern portions by a partial printing area K, as shown in FIGS. 13A and 13B.

Thus, with the carton printing method 5, the non-common printing pattern portions, such as the quantity of the articles to be housed 9, are partially printed at the time of printing different printing patterns on the punched carton units for improving the printing efficiency.

With the above-described first embodiment of the carton processing method 5, since the article to be printed 14, supplied to the printing device 10, is a punched carton unit, obtained on previously punching the crude roll paper or sheet, and hence position errors otherwise produced at the printing position of the printing pattern may be diminished, the printed pattern may be improved in position accuracy.

In other words, since the punching or press working for forming folding lines or slit lines in the article 4 after printing the printing pattern thereon is eliminated with the present carton processing method 5, the position precision of the printed pattern may be maintained reliably.

Figure 14:
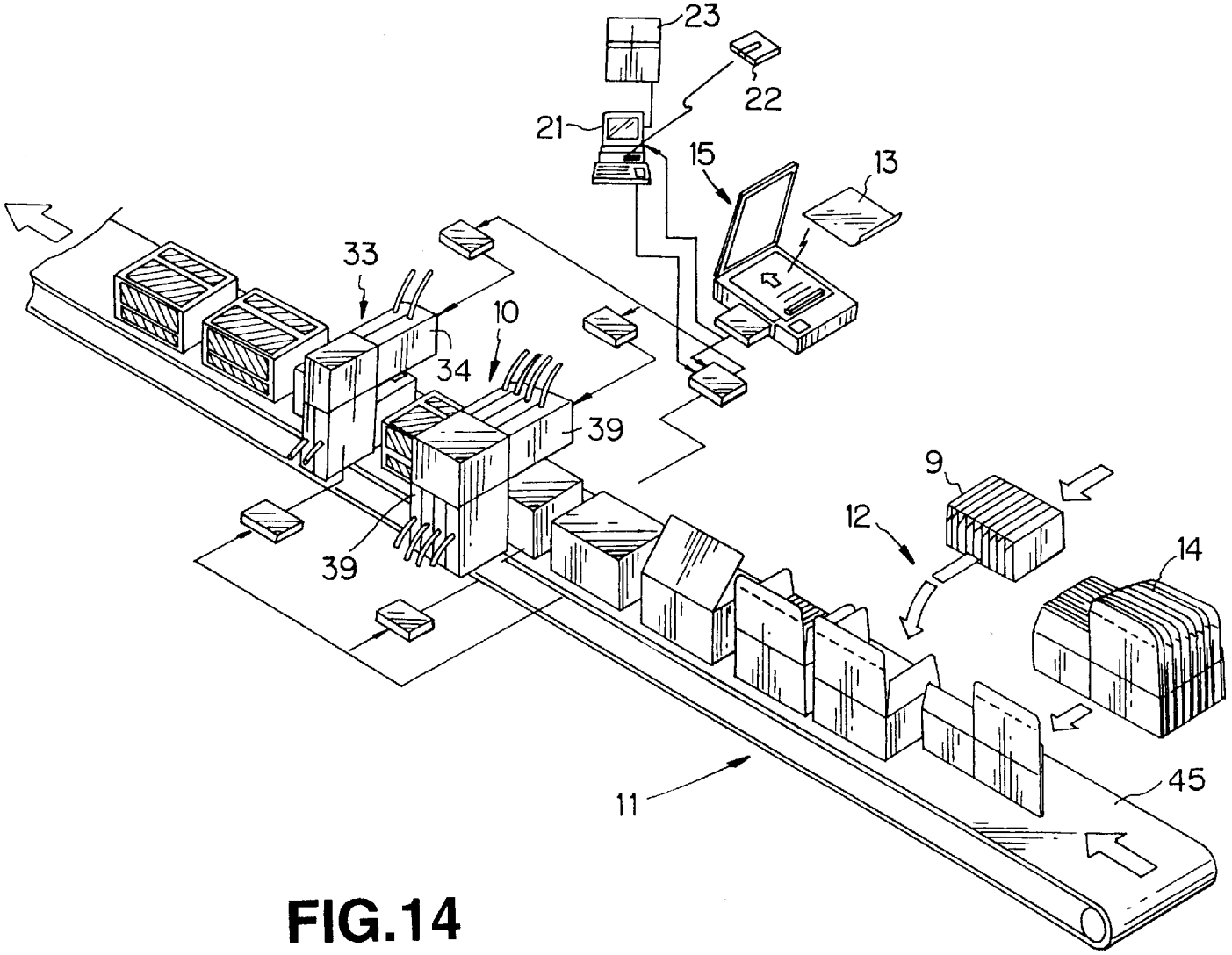
FIG. 14 is a perspective view showing the carton processing system employing the carton processing system according to a second embodiment of the present invention.

Referring to FIG. 14, a carton processing method 6 according to a second embodiment of the present invention, employing the carton processing system 1, is explained. The carton processing method 6 includes a first step of assembling the punched carton unit to a carton shape, a second step of housing the articles to be housed 9 within the assembled carton and a third step of printing the carton having the articles 9 housed therein.

The first step is an assembling step of folding and coating a sizing to the punched carton unit for assembling the unit to a carton shape. The punched carton unit, which is previously folded and on the folding portions (flaps) of which the sizing is applied, is supplied to the assembling step.

The punched carton unit is transported to the printing device 10 by a transporting route constituted by the belt conveyor 45. The assembling device 11 and the loading device 12 are provided partway on the transporting route of the belt conveyor 45. The assembly step assembles the punched carton unit on the belt conveyor 45 by sucking both side flaps by the assembling device 11.

The second step is the loading step of housing the articles to be housed 9, such as disc cartridges, in the assembled carton. The loading device 12 houses a pre-set number of the articles 9 in the assembled carton. The lid of the carton is closed after the articles 9 have been housed in the carton.

The third step is a printing step of printing the carton housing the articles 9 therein. The printing step effects printing on the designated printing area on the peripheral portion of the carton by the printing device 10. A coater 33, provided on the carton transporting route in adjacency to the printing device 10, applies a printing protective agent on the printing surface of the carton on which the printing pattern has been printed. The printing protecting agent, thus applied, is dried. The carton, on which the printing pattern has been printed, is transported to a packaging step, not shown, for packaging.

With the above-described second embodiment of the carton processing method 6, since the printing device 10 is of the ink jet printing system and hence has a printing head 39, and printing is performed while the printing head 39 is kept out of contact with the article 14, printing may be made reliably on the article 14 assembled into a box shape. The result is that position errors in the printing position of the printing pattern may be eliminated, thus improving accuracy in printing pattern positions and printing quality.

That is, since the carton processing method is applied to printing on the carton-shaped products as the articles to be printed 14, it becomes possible to effect reliable printing without being adversely affected by warping, distortion or micro-irregularities on the printing surface. The result is that printing defects, such as color irregularities, color skip or color vanishing or blurred characters, are not produced with the carton processing method 6 on the printed patterns, such as printed characters or printed pictures.

The carton processing method according to the present invention may be conveniently applied in particular to the processing of relatively small-sized cartons, such as cartridge casings.

What is claimed is:

1. A method for processing a carton, comprising the steps of:

supplying articles for printing;

printing on said articles a printing pattern comprising a design or information describing the contents of articles to be housed within said carton, including the names or quantity of the articles to be housed within the carton;

assembling each of said articles for printing into a carton;

loading each of the articles to be housed into a carton formed by said assembling step;

interconnecting the steps for supplying articles accompanied by a step of transporting said articles to be printed for printing, printing, assembling, and loading by interconnecting respective means for supplying articles for printing, means for printing, means for assembling, and means for loading; and controlling by a production supervising computer the steps for supplying the articles for printing, printing, assembling means, loading and transporting;

wherein the printing patterns printed on said articles for printing are automatically switched based upon a production supervising signal outputted by said production supervising computer;

wherein said printing is accompanied by a step of reading out a printing pattern of a color printing original to be printed on the articles to be printed;

wherein the articles to be printed are printed based upon picture information signals read out by reading out step; and wherein said printing step is accompanied by a step of moving the position of the color printing original set during said reading out step.

2. The carton processing method as claimed in claim 1, wherein said transporting step has a step for controlling by a supply controller the supply rate of the articles to be printed, and wherein said supply controller synchronizes the printing speed of printing on the articles to be printed during said printing step with the supply rate of supplying the articles to be printed to said printing means.

3. The carton processing method as claimed in claim 1, further comprising a coating step for applying a printing protective agent on printing surfaces of the printed articles.

4. A method for processing a carton housing articles to be housed from articles to be printed, comprising the steps of:

supplying articles to be printed, wherein the articles to be printed are provided in a pre-set shape and have folding lines formed in pre-set portions, wherein the articles to be printed are adapted to be folded along the folding lines to assemble the articles to be printed into a carton for storing articles to be housed;

printing a printing pattern and a name and quantity of the articles to be housed on said articles to be printed to form printed articles;

assembling the printed articles into cartons; and storing articles to be housed within the cartons.

5. The carton processing method as claimed in claim 4 wherein said printing step prints the printing pattern at a pre-set distance from the folding lines.

6. The carton processing method as claimed in claim 4, wherein said printing step includes a sub-step of printing a common printing pattern portion on the articles to be printed and a sub-step of separately printing non-common, different printing patterns on the articles to be printed on which the common printing pattern has been previously printed.

7. A method for processing a carton comprising the steps of:

supplying articles to be printed, wherein the articles to be printed are provided in a pre-set shape and have folding lines formed in pre-set portions;

assembling the articles to be printed into a carton by folding the articles to be printed along the folding lines;

accommodating articles to be housed within the carton; and printing a printing pattern and contents of the carton on an outer surface of the carton, wherein printing the contents includes printing the name and quantity of the articles to be housed.

8. The carton processing method as claimed in claim 7, wherein said printing step includes a sub-step of printing a common printing pattern portion on the carton and a sub-step of separately printing non-common, different printing patterns on the carton on which the common printing pattern has been previously printed.

* * * * *